US006539889B2

(12) United States Patent
Simpson

(10) Patent No.: US 6,539,889 B2
(45) Date of Patent: Apr. 1, 2003

(54) FRAME, INFLATABLE SKIN AND WATERCRAFT FORMED FROM SAME

(76) Inventor: Douglass Edward Simpson, 3091 W. 3rd Ave., Vancouver, British Columbia (CA), V6K 1M9

( * ) Notice: Subject to any disclaimer, the term of this patent is extended or adjusted under 35 U.S.C. 154(b) by 0 days.

(21) Appl. No.: 09/882,578

(22) Filed: Jun. 14, 2001

(65) Prior Publication Data

US 2002/0189523 A1 Dec. 19, 2002

(51) Int. Cl.[7] ..... B63B 7/00
(52) U.S. Cl. ..... 114/345; 114/347; 114/354
(58) Field of Search ..... 114/343, 345, 114/347, 351, 352, 353, 354

(56) References Cited

U.S. PATENT DOCUMENTS

| | | | | |
|---|---|---|---|---|
| 2,743,510 A | * | 5/1956 | Mauney et al. | 114/345 |
| 4,031,580 A | | 6/1977 | Neumann et al. | 9/2 A |
| 4,057,865 A | * | 11/1977 | Trautwein | 114/345 |
| 4,274,170 A | | 6/1981 | Simpson | 9/1.4 |
| 4,589,365 A | | 5/1986 | Masters | 114/347 |
| 4,597,355 A | | 7/1986 | Kirby | 114/345 |
| 4,681,060 A | | 7/1987 | Masters | 114/347 |
| 4,715,311 A | * | 12/1987 | Masters | 114/347 |
| 4,816,002 A | * | 3/1989 | Brodrib | 280/1.181 |
| 4,821,666 A | | 4/1989 | Ingram | 114/347 |
| 4,841,899 A | | 6/1989 | Fleckles et al. | 114/347 |
| 5,299,524 A | | 4/1994 | Szilagyi | 114/345 |
| 5,615,634 A | | 4/1997 | Gonda | 114/354 |
| D385,528 S | | 10/1997 | Cronin | D12/302 |
| 5,680,828 A | | 10/1997 | Totten | 114/347 |
| 5,875,731 A | | 3/1999 | Abernethy et al. | 114/354 |
| 5,915,327 A | * | 6/1999 | Elvestad | 114/347 |
| 5,921,197 A | | 7/1999 | Wagner | 114/347 |
| 5,964,177 A | | 10/1999 | Niemier | 114/347 |
| 6,019,263 A | | 2/2000 | Palmer | 224/261 |
| 6,065,421 A | | 5/2000 | Haller et al. | 114/347 |
| D427,561 S | | 7/2000 | Haller et al. | D12/302 |
| 6,129,600 A | | 10/2000 | Nordby | 440/101 |
| 6,152,063 A | | 11/2000 | Niemier | 114/347 |

FOREIGN PATENT DOCUMENTS

SU 01828822 A1 * 7/1993 ..... 114/347

OTHER PUBLICATIONS

Brochure entitled "Kahuna" by Feathercraft Folding Kayaks; 1998; pp. 8–20.
Kuhne, Cecil; "Kayaks"; Canoe & Kayak Magazine; Dec. 2000, pp. 84–95.
Kuhne, Cecil; "Inflatables"; Canoe & Kayak Magazine; Dec. 2000; pp. 136–140.

* cited by examiner

*Primary Examiner*—Stephen Avila
(74) *Attorney, Agent, or Firm*—Fulbright & Jaworski L.L.P.

(57) ABSTRACT

A watercraft comprising an inflatable skin operable to define a hull shape when inflated, and a frame comprising an extendible rigid keel member engageable with the inflatable skin to stretch the inflatable skin to define a rigid keel form in the inflatable skin. The frame may further comprise chine or gunwale stiffeners connectable to the keel member to extend lengthwise along or over port and starboard sides of the inflatable skin. The inflatable skin may further comprise bow and stern connectors for connecting the inflatable skin to the frame at a bow and a stern of the watercraft, respectively. The keel member of the frame when extended defines the rigid keel form, which curves upward at the bow and stern. The chine and gunwale stiffeners of the frame when expanded resist the upward curvature of the bow and stern, leading to a longer waterline and a faster watercraft.

80 Claims, 13 Drawing Sheets

FRAME, INFLATABLE SKIN AND WATERCRAFT FORMED FROM SAME

BACKGROUND OF THE INVENTION

1. Field of Invention

This invention relates to watercraft, and more particularly to a frame, an inflatable skin, and a watercraft formed from same and methods of assembly.

2. Description of Related Art

Inflatable watercraft have become tremendously popular as practical and efficient outdoor gear. Inflatable watercraft have allowed outdoor adventurers to access relatively remote locations due to their ability to be disassembled and quickly reassembled. Inflatable watercraft also respond actively to changing water conditions by absorbing wave energy such as from ocean surges for example, giving paddlers a sense of security. In addition, inflatable watercraft have also provided an inexpensive mode of aquatic enjoyment for use by both novice and seasoned paddlers in whitewater rapids, flat lakes, mild rivers, or ocean, for both day trips and extended wilderness expeditions. Inflatable watercraft are popular in whitewater rapids for example because they are wide and very stable, which allows beginners to tackle rapids they would be unlikely to attempt in a hard shell boat.

However, inflatable watercraft have typically been used mostly for whitewater alone because they are more sluggish than hard shell boats on flatwater, due to a tendency to sag amidships when loaded with gear or passengers, causing lifting of the bow and stern of the watercraft. While a degree of bow and stern lift allows the watercraft to more easily pivot and reduces the entry of water into the bow and stern of the watercraft, too much lift can cause the watercraft to be more adversely affected by large waves, increasing the risk of swamping from transverse waves especially. In addition, a wind blowing upstream can cause a lifted bow or stern of an inflatable watercraft to act like a sail, making. even downstream progress more difficult.

Inflatable watercraft used on flatwater usually have problems tracking (holding a straight-line course without constant paddle correction) since most inflatable watercraft lack a keel bar and thus have a significant component of drift, especially over long distances.

Attempts to overcome these problems have involved employing an isoskeleton frame comprising a plurality of longitudinal and transverse supports forming plaquettes inside an outer skin of a watercraft to provide enhanced rigidity. Inflatable air bladders have been employed in only a few of the plaquettes of the isoskeleton frame to provide flotation of the watercraft. The inflatable air bladders by themselves do not form a hull shape and cannot support the weight of passengers or gear nor do they provide a watertight surface. Further there are many parts to the isoskeleton frame, which can be lost and/or damaged, and such an arrangement does not provide the same floatation and durability to impacts with rocks for example that strictly inflatable watercraft without frames can provide.

What is desired therefore is a watercraft that overcomes these problems.

SUMMARY OF THE INVENTION

The present invention addresses the above needs by providing a frame for a watercraft, an inflatable skin for a watercraft, and a watercraft formed from same.

In accordance with one aspect of the invention, there is provided a watercraft comprising an inflatable skin operable to define a hull shape when inflated and a frame comprising an extendible rigid keel member engageable with the inflatable skin to stretch the inflatable skin to define a rigid keel form in the inflatable skin.

The extended rigid keel member provides for a fairly straight hull to reduce sag of the watercraft when loaded with gear or passengers. This gives a longer waterline compared to the overall length of the watercraft than an inflatable watercraft without a frame support, and allows the watercraft greater maneuverability and less susceptibility to deleterious effects of strong winds and large waves. In addition, the presence of the defined keel form provides greater tracking ability than an inflatable watercraft without a frame. The defined keel form also gives a bow of the inflatable watercraft a defined shape which reduces turbulence and increases speed.

In accordance with another aspect of the invention, there is provided an inflatable skin for a watercraft. The inflatable skin includes a port hull portion and a starboard hull portion, the port and starboard hull portion being operable to receive an extendible rigid member of a frame lengthwise therebetween, and bow and stern connectors operable to connect the inflatable skin to the frame near a bow and a stern of the watercraft, respectively. The inflatable skin is operable to define a hull shape when inflated, and is engageable with the frame to stretch the inflatable skin to define a rigid keel form in the inflatable skin.

The port and starboard hull portions may be inflatable and may be connectable together to form a keel pocket to accept the keel member. The keel member may be receivable lengthwise between the port hull portion and the starboard hull portion.

The port and starboard hull portions may include port and starboard chambers operable to receive respective inflatable sponsons. The inflatable skin may also include inflatable sponsons operable to be received in the port and starboard chambers. Alternatively or in addition, the port and starboard chambers may be airtight and operable to be inflated.

The port and starboard hull portions may have closeable openings to provide access to the port and starboard chambers to permit insertion and removal of the respective inflatable sponsons.

The port and starboard hull portions may include port and starboard hull and deck chambers, respectively. The port and starboard deck chambers may be operable to receive port and starboard deck sponsons, and the port and starboard hull chambers may be operable to receive port and starboard hull sponsons, respectively, and may have closeable openings for receiving the port and starboard deck and hull sponsons, respectively. The port and starboard deck and hull inflatable sponsons may also be included. The inflatable skin may further include port and starboard dividers dividing the port and starboard chambers into port and starboard deck and hull chambers.

The inflatable skin may also include a hull skin portion and port and starboard deck skin portions. The hull skin portion and port and starboard deck skin potions may be comprised of an abrasion resistant, waterproof fabric, such as urethane, neoprene, polyvinyl chloride, or rubber coated nylon or polyester fabric. The hull skin portion may be operable to support a skeg.

A seat may be connected to the port and starboard deck skin portions, to facilitate seating of a user.

In accordance with another aspect of the invention, there is provided a frame for a watercraft. The frame includes an extendible rigid keel member engageable with an inflatable skin of the watercraft to stretch the inflatable skin to define a rigid keel form in the inflatable skin.

The keel member may include first and second keel member portion pivotally connectable to each other, and a lock operable to lock the first and second keel member portion against relative pivotal movement.

The frame may also include port and starboard chine stiffeners connectable to the keel member to extend lengthwise along port and starboard sides of the inflatable skin, and may extend lengthwise between a port deck chamber and a port hull chamber, and lengthwise between a starboard deck chamber and a starboard hull chamber, respectively, of the inflatable skin. The port and starboard chine stiffeners, and the keel member may be pivotally connectable to each other.

The frame may also include a bow joiner and a stern joiner to connect the keel member, and the port and starboard chine stiffeners together, respectively. The bow and stern joiners may cooperate with bow and stern connectors on the inflatable skin to connect the inflatable skin to the frame at a bow and a stern of the watercraft, respectively. The keel member, port and starboard chine stiffeners may be shaped to curve upwardly for receipt into a receptacle on the inflatable skin to lie on port and starboard deck chambers of the inflatable skin, respectively.

The port and starboard chine stiffeners may be collapsible, and the keel member and the port and starboard chine stiffeners may include a plurality of detachable stiffener portions. Further, at least one of the port and starboard chine stiffeners may include a foot support.

The frame may also include port and starboard gunwale stiffeners connectable to the keel member to extend lengthwise over port and starboard sides of the inflatable skin, and may extend lengthwise over a port deck chamber, and lengthwise over a starboard deck chamber, respectively, of the inflatable skin.

The port and starboard gunwale stiffeners, and the keel member may be pivotally connectable to each other, and the port and starboard gunwale stiffeners may be collapsible. The keel member and the port and starboard gunwale stiffeners may comprise a plurality of detachable stiffener portions.

The keel member of the frame may be operable to support a skeg, and the frame may include the skeg.

In accordance with another aspect of the invention, there is provided a method of assembling a watercraft. The method includes engaging an elongated keel member of a frame with an inflatable skin operable to define a hull shape when inflated to stretch the inflatable skin to define a rigid keel form in the inflatable skin. The elongated keel member of the frame may be engaged with the inflatable skin by pivoting a first portion of the keel member relative to a second portion of the keel member, and also may include locking the keel member portions against relative pivotal movement when the keel member is engaged with the inflatable skin. The method may also include engaging a chine stiffener with the inflatable skin to stiffen the inflatable skin. This may include rotating the chine stiffener downwardly towards the keel member to stretch the inflatable skin longitudinally along the keel member. The method may also include inflating the inflatable skin.

The keel member of the frame when extended defines the rigid keel form, which curves upward at the bow and stern of the watercraft. The chine and gunwale stiffeners of the frame when expanded resist the upward curvature of the bow and stern, leading to a longer waterline and a faster watercraft.

The features of the frame, inflatable skin and the watercraft formed from same provide a relatively inexpensive, light weight watercraft which can be quickly assembled and disassembled for economy of storage and ease of transport to distant aquatic locations. The materials used for the watercraft allow for low-cost repairs and ease of replacement of parts. Further the watercraft described herein provides rigidity against sag, maneuverability, and ease of movement in various water conditions, thereby providing performance comparable to that of hard-shelled watercraft.

Other aspects and features of the present invention will become apparent to those ordinarily skilled in the art upon review of the following description of specific embodiments of the invention in conjunction wit the accompanying figures.

BRIEF DESCRIPTION OF THE DRAWINGS

In drawings which illustrate embodiments of the invention.

DETAILED DESCRIPTION

Figure 1:
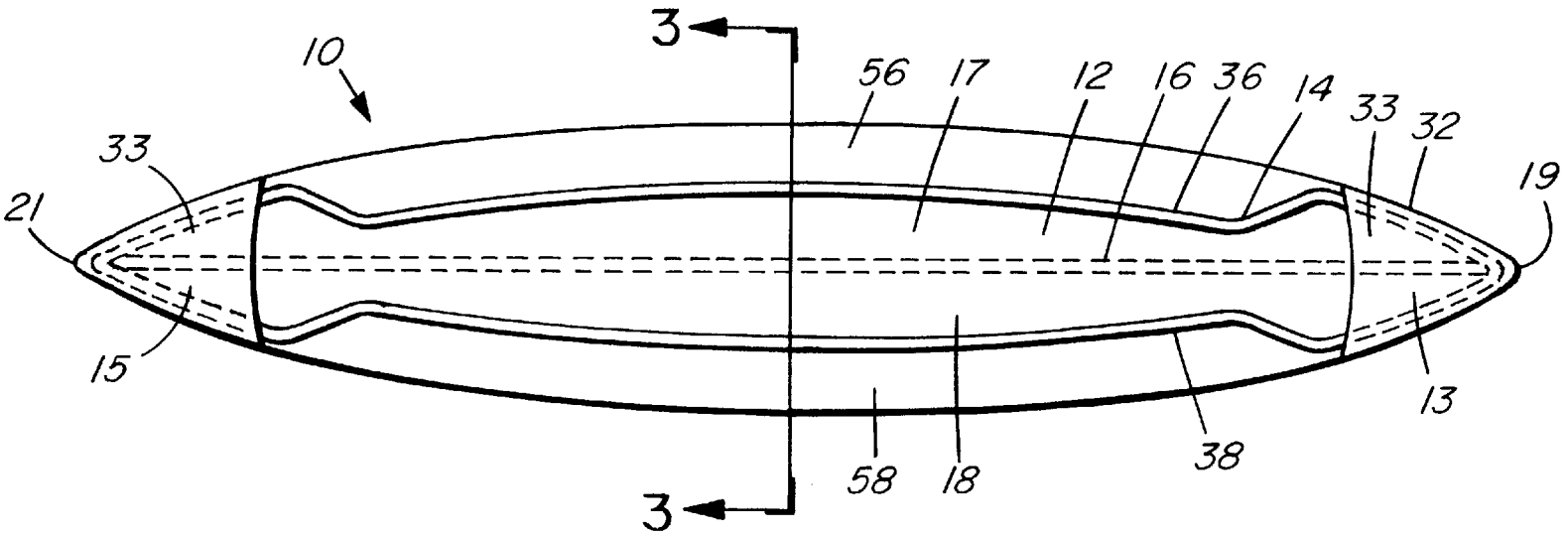
FIG. 1 is a top plan view of the watercraft according to one embodiment of the invention.
Figure 2:
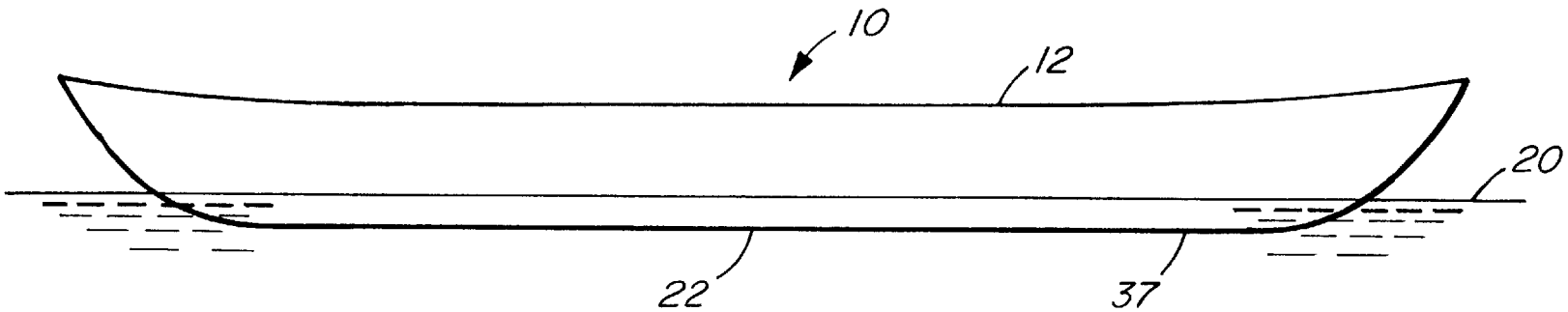
FIG. 2 is a side view of the watercraft shown in FIG. 1.
Figure 3:
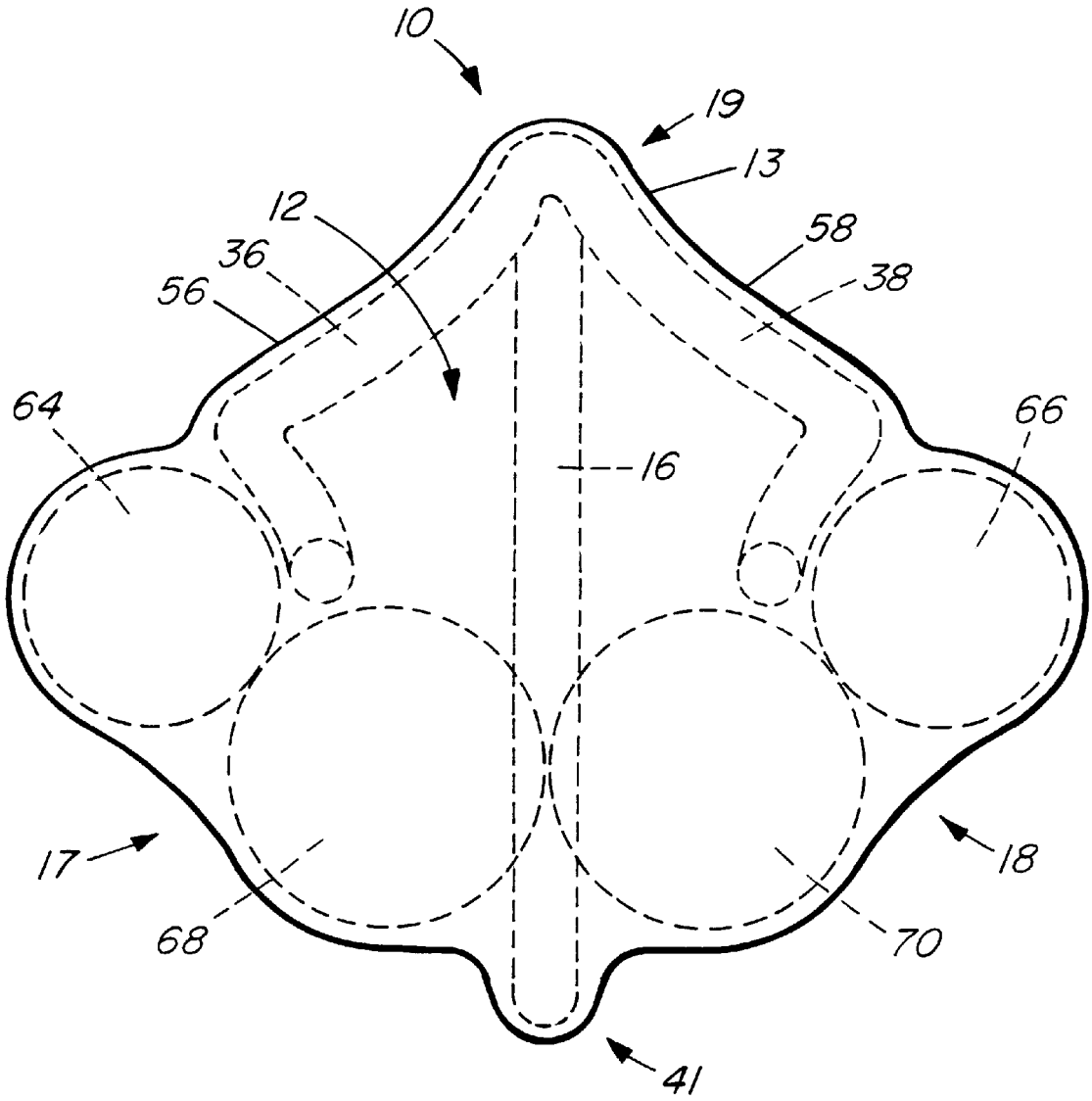
FIG. 3 is a front view of the watercraft shown in FIG. 1.

Referring to FIGS. 1, 2, and 3, a watercraft according to a first embodiment of the invention is shown generally at 10. In this embodiment, the watercraft 10 comprises an inflatable skin 12 operable to define a hull shape when inflated, as shown generally at 37 in FIG. 2, and a frame shown at 14 in FIG. 1 comprising an extendible rigid keel member 16 engageable with the inflatable skin to stretch the inflatable skin to define a rigid keel form in the inflatable skin, as shown generally at 41 in FIG. 3.

Referring to FIG. 2, one of the functions of the extendible rigid keel member 16 is to provide for a fairly straight hull 37 to reduce sag of the watercraft 10 below the water level 20 when loaded. This gives a longer waterline 22 compared to the overall length of the watercraft 10 than an inflatable watercraft without a frame support, and allows the watercraft finer entry for smooth laminar water flow and less susceptibility to deleterious effects of strong winds and large waves.

Referring to FIG. 3, the rigid keel form 41 also provides for tracking through water with greater directivity since the keel form reduces the tendency of the watercraft 10 to veer off a straight line. This enables the watercraft 10 to be faster than an inflatable kayak on flatwater, and in combination with the fairly straight hull shape 37 shown in FIG. 2 allows the watercraft to be less affected by large waves and wind. Inflatable skin Referring back to FIG. 1, to achieve the above advantages, in this embodiment the inflatable skin 12 includes a port hull portion 17 and a starboard hull portion 18 extending lengthwise along the full length of the watercraft. Alternatively, the inflatable skin 12 may comprise a single hull portion. In this embodiment the port hull portion 17 is connected to the starboard hull portion 18 and joined at a bow 19 and a stern 21, respectively, of the watercraft 10. The keel member 16 is receivable lengthwise between the port hull portion 17 and the starboard hull portion 18.

In this embodiment, the inflatable skin 12 includes a bow and a stern connector 13 and 15 for connecting the inflatable skin to the frame 14 at the bow 19 and stern 21 of the watercraft 10, respectively.

The inflatable skin 12 also includes a hull skin portion 32 covering the water-facing surface of the port and starboard hull portions 17 and 18, respectively, and port and starboard deck skin portions 56 and 58, covering deck surfaces of the port and starboard hull portions, respectively.

Figure 4A:
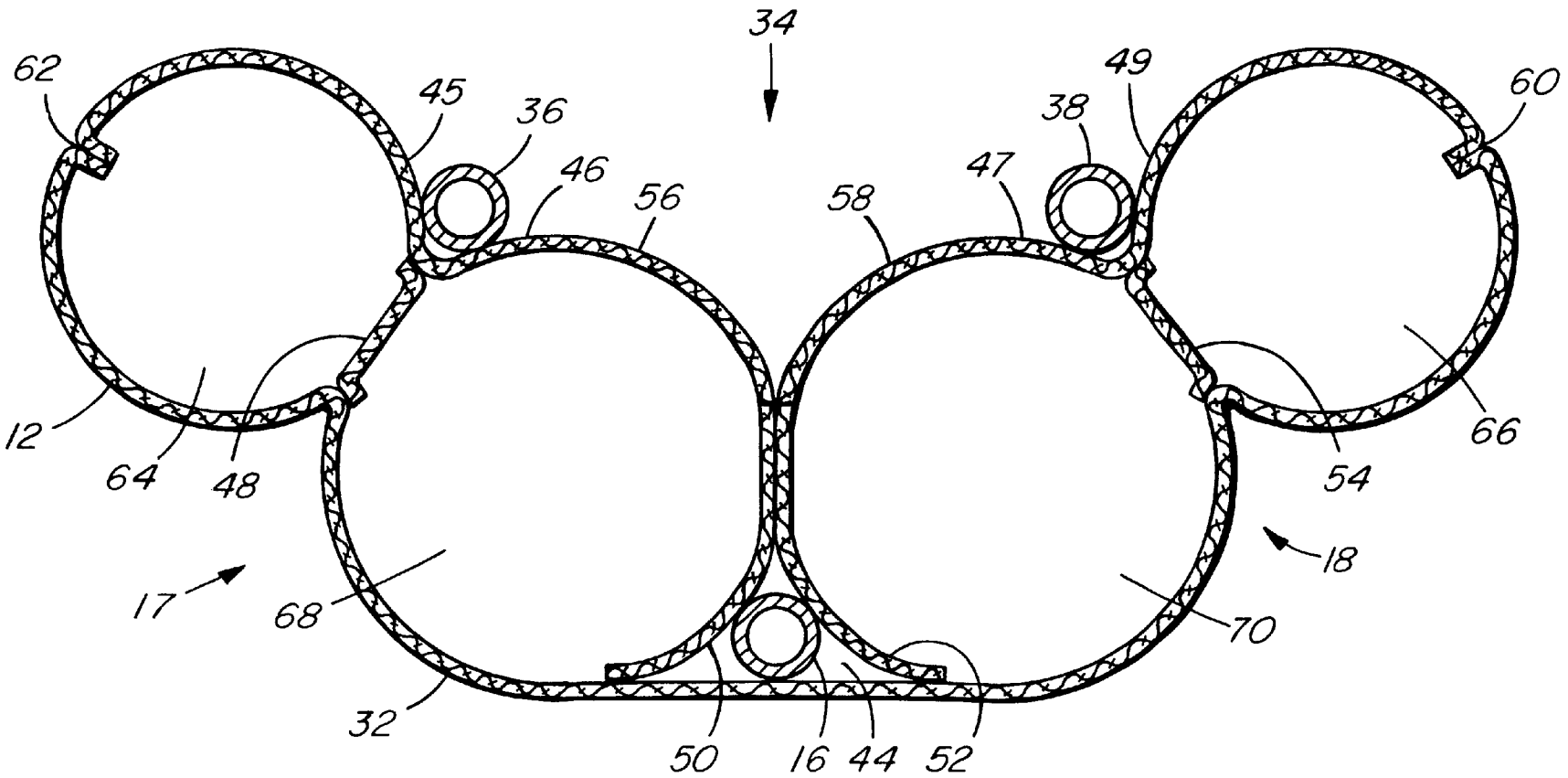
FIGS. 4A and 4B are cross-sectional views of the watercraft of the embodiment shown in FIG. 1 taken along the line 3—3 of FIG. 1.
Figure 4B:
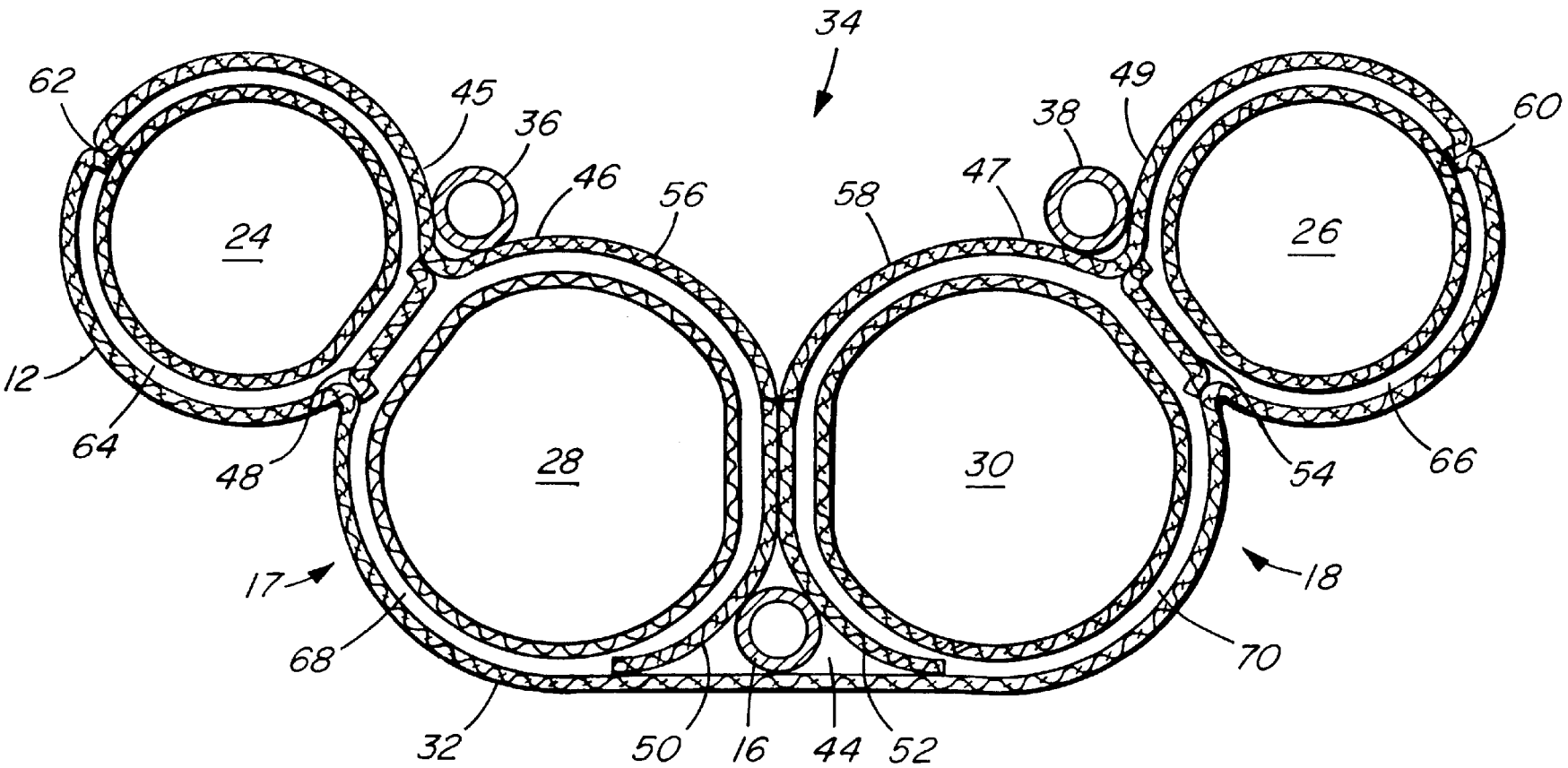

Referring to FIGS. 4A and 4B, cross-sectional views of the watercraft 10 taken along the 3—3 line shown in FIG. 1 are shown generally at 34 in FIGS. 4A and 4B. The port and starboard deck skin portions 56 and 58 are joined to the hull skin portion 32 at starboard and port deck/hull seams 60 and 62, respectively, to form the inflatable skin 12 of the watercraft 10.

In this embodiment, the hull skin portion 32 is made of Duratek. Duratek is made from a ballistic 840 denier high tenacity, balanced weave, nylon base fabric which is impregnated on both sides with a polyurethane solution coat, followed by a series of additional polyurethane coats. The impregnation of the solution coat to the base fabric ensures a complete bond with no delamination. Other materials, such as hypalon, which is glueable and highly abrasion resistant, and polyvinyl chloride which is softer but heat sealable, may be used.

In this embodiment, the port and starboard deck skin portions 56 and 58 comprises a port and starboard sewn cloth deck made from urethane coated polyester fabric. Alternatively, other materials, such as Nylon Cordura, which can be welded to other materials to form a watertight seal, and is abrasion resistant, may be used.

In addition, the hull and the port and starboard deck skin portions 32, 56 and 58 may be comprised of neoprene or rubber coated nylon or polyester fabric.

In other words, the starboard sewn cloth deck 58, the port sewn cloth deck 56, the hull skin portion 32 form the essentially watertight and highly abrasion resistant inflatable skin 12 of the watercraft 10.

In an alternative embodiment, the port and starboard sewn cloth deck 56 and 58 may include mounts (not shown) mounted on the outer surfaces of the port and starboard sewn cloth deck which allows for possible connection of deck rigging, a rudder, and/or a seat, for example, to be mounted onto the inflatable skin 12 of the watercraft 10. Other mounts may be included which allow for the mounting of other watercraft and rigging accessories onto the watercraft.

The starboard sewn cloth deck 58 is sewn to the hull skin portion 32 at a starboard deck/hull seam 60 along the entire length of the watercraft 10 and the port sewn cloth deck 56 is sewn to the hull at the port deck/hull seam 62 along the entire length of the watercraft. In this embodiment four strips of urethane coated nylon fabric 48, 50, 52 and 54 are hot air welded to the inside of the hull skin portion 32 along most of its length. Other materials may be also be used for these strips. The starboard sewn cloth deck 58 is sewn to the strip 54 while the port sewn cloth deck 56 is sewn to the strip 48 along the entire length of the watercraft 10. Since the strips 48 and 54 are also welded to the hull skin portion 32, an elongated port deck chamber 64 and a starboard deck chamber 66 are formed along the entire length of the watercraft 10 to receive inflatable floats, which in this embodiment include inflatable sponsons. In addition, the port sewn cloth deck 56 is sewn to the strip 50 also connecting it to the hull skin portion 32, while the starboard sewn cloth deck 58 is sewn to the strip 52 connecting it to the hull skin portion. This defines an elongated port hull chamber 68 and an elongated starboard hull chamber 70 operable to receive inflatable floats.

In other words, the inflatable skin 12 includes port and starboard dividers 48, 50, 52, and 54 dividing port and starboard hull portions 17 and 18 into port and starboard deck and hull chambers 64, 68, 66, and 70, respectively. Thus in effect, the port and starboard hull portions 17 and 18 include port and starboard hull and deck chambers 64, 68 and 66, 70, operable to receive respective inflatable sponsons. In an alternative embodiment, the port and starboard hull portions 17 and 18 may include separate port and starboard deck and hull chambers operable to receive inflatable sponsons, for example. Alternatively, the port and starboard hull and deck chambers 64, 66, 68, and 70 may be operable to receive other types of inflatable portions such as air bladder systems, for example. In addition, the seams 60 and 62 may be welded or glued and port sewn cloth deck 56 may be welded or glued to the port hull portion 17 at dividers 48 and 50, and the starboard sewn cloth deck 58 may be welded or glued to the starboard hull portion 18 at dividers 54 and 52 so that the inflatable skin 12 is airtight. In this embodiment the inflatable sponsons 24, 26, 28 and 30 would not be needed.

Referring to FIG. 4B, in this embodiment, the cross-sectional view 34 of the watercraft 10 is shown with the port and starboard deck and hull inflatable sponsons 24 and 26, and 28 and 30 positioned inside of respective chambers 64, 66, 68 and 70. In this embodiment, the inflatable sponsons 24, 26, 28, and 30 are patchable sponsons comprised of urethane. Alternatively, other floatation devices may be used, such as air bladder systems, for example, to provide floatation of the watercraft 10.

In addition, the port and starboard sewn cloth decks 56 and 58 have closeable openings, which in this embodiment are hook and loop fasteners 45, 49 and 46, 47 respectively, which allow accessibility to the port and starboard deck and hull chambers 64, 66, 68 and 70, respectively. This allows the inflatable port and starboard deck and hull sponsons to be inserted into the respective chambers to define the overall shape of the watercraft 10, and allows for easy removal of the inflatable sponsons for repair or replacement. Thus the port and starboard hull portions 17 and 18 have closeable openings to provide access to the port and starboard deck and hull chambers 64, 66, 68 and 70, respectively to permit insertion and removal of the respective inflatable sponsons 24, 26, 28, and 30.

In addition, the hull skin portion 32 and the port and starboard hull portions 17 and 18 may contain openings (not shown) situated under the stern 21 of the watercraft 10, making the watercraft self-bailing. If a paddler sits at a level higher than the waterline, water enters the watercraft 10 through the openings on the port and starboard hull portions 17 and 18 until the level of water inside the watercraft stabilizes even with the waterline.

The port and starboard hull portions 17 and 18 are connected together to form a keel pocket 44 to accept the keel member 16. Additional hook and loop fasteners (not shown), sewn onto pieces of fabric (similar to the fabric used for the hull portions 17 and 18) welded onto the inside of the hull portions at a minimum of three locations along the joining of the port and starboard hull portions, are used to hold the keel member 16 properly aligned in the keel pocket 44 along the length of the watercraft. Thus, the keel member 16 is receivable lengthwise between the port hull portion 17 and the starboard hull portion 18.

Figure 4C:
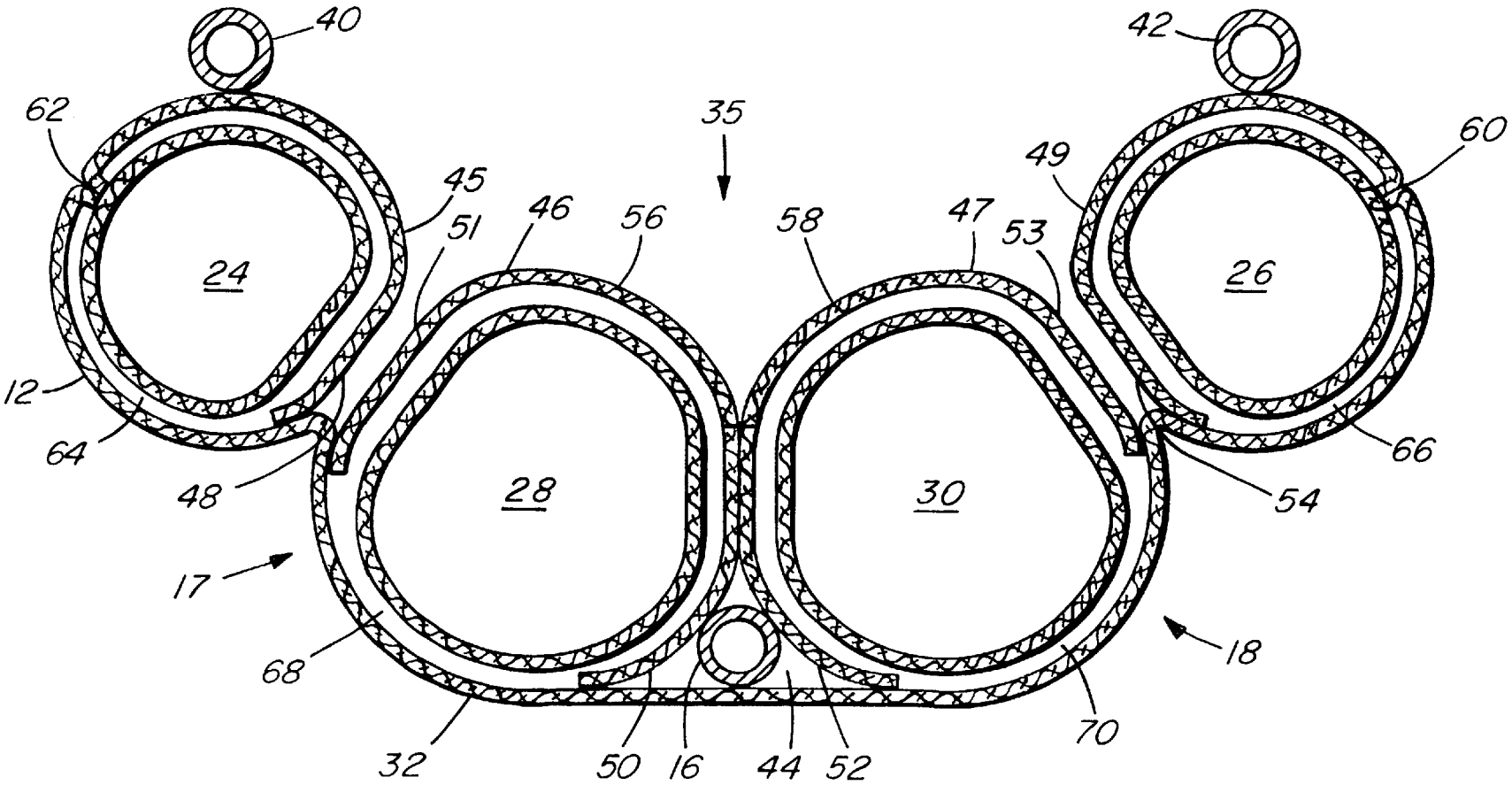
FIG. 4C is a cross-sectional view of the watercraft taken along the line 3—3 of FIG. 1 according to an alternate embodiment of the invention.

Referring to FIG. 4C, a cross-sectional view of the watercraft 10 according to an alternative embodiment is shown generally at 35 in FIG. 4C. In this embodiment, the port and starboard hull portions 17 and 18 are configured to provide a narrow beam of the watercraft, which may be particularly suited to be operable as a surf ski, for example.

Figure 4D:
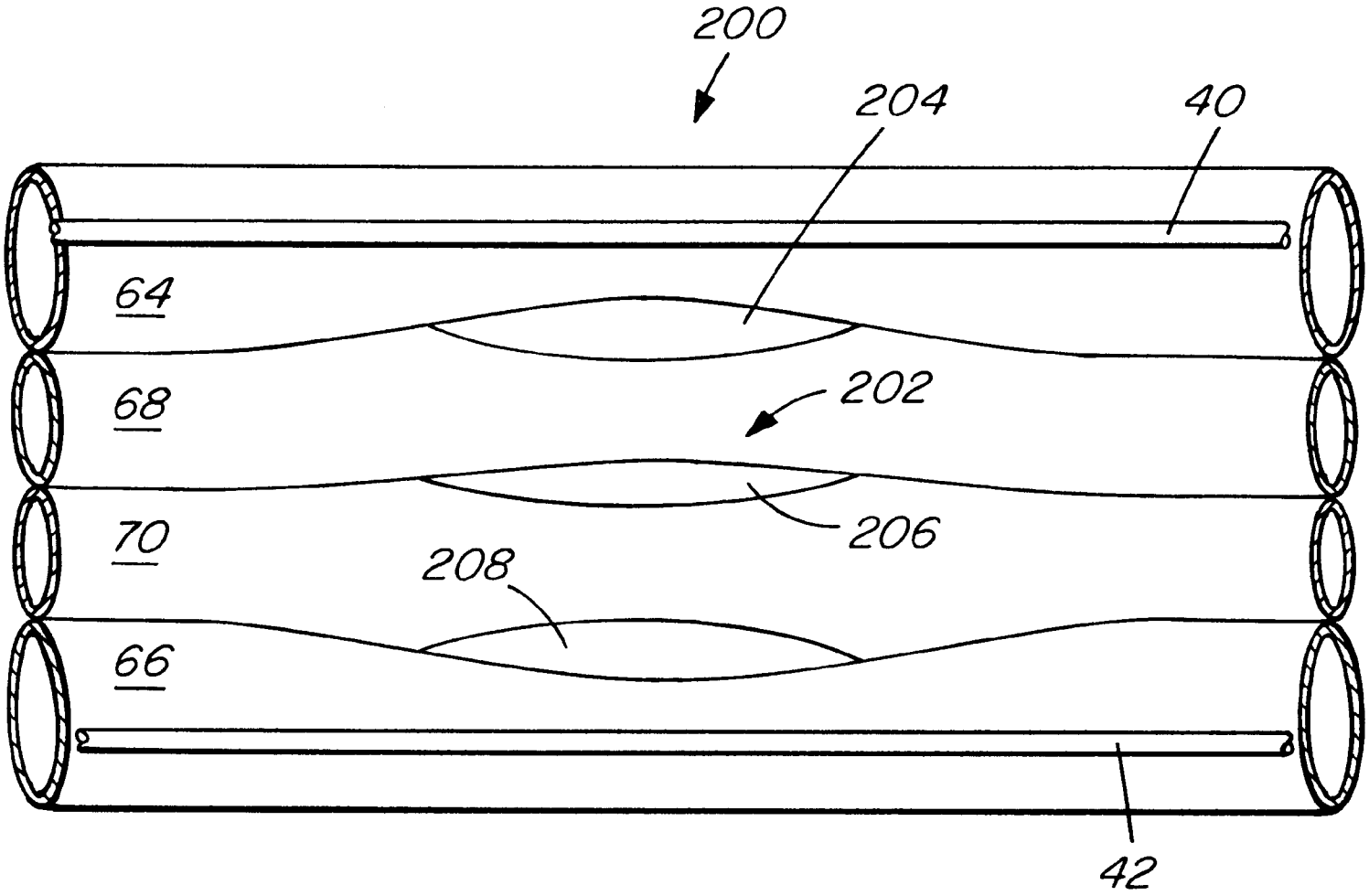
FIG. 4D is a top plan view of a watercraft according to the alternate embodiment of the invention shown in FIG. 4C.

Referring to FIG. 4D, a top plan view of the inflatable skin according to the alternative embodiment shown in FIG. 4C is shown generally at 200 in FIG. 4D. In this embodiment the inflatable skin 200 includes a cavity 202 formed between the port and starboard deck chambers 64 and 66 near amidships to allow for the positioning of a seat located at or just below the waterline to provide stability to the watercraft. The cavity 202 is generally wide enough to allow hips of a paddler to fit between the port and starboard deck chambers 64 and 66.

Referring to FIGS. 4C and 4D, in this embodiment, near amidships the port deck chamber 64 is separated from the port hull chamber 68 by an additional strip of fabric 51 welded to the hull skin portion 32 and sewn to the port deck skin portion 56, and the starboard deck chamber 66 is separated from the starboard hull chamber 70 by another additional strip of fabric 53 welded to the hull skin portion 32 and sewn to the starboard deck skin portion 58. Thus the port and starboard deck and hull chambers 64, 66, 68, and 70 are narrower amidships than they are in other areas of the watercraft 10. Specifically, the port and starboard hull chambers 68 and 70 are cut on port and starboard sides, while the port and starboard deck chambers 64 and 66 are cut on sides facing respective hull chambers to form separate cavities 204, 206 and 208, respectively.

Frame

Referring to FIGS. 1, 3, 5A, and 5B, the frame which cooperates with the inflatable skin is shown at 14 and includes the extendible rigid keel member 16 shown in broken outline in FIG. 1. Referring to FIGS. 1, 3, and 4A, in this embodiment, the keel member 16 is receivable lengthwise between the port hull portion 17 and the starboard hull portion 18.

Referring back to FIGS. 1, 3, 5A, and 5B, in this embodiment, the frame 14 also includes port and starboard chine stiffeners 36 and 38 connectable to the keel member 16 to extend lengthwise along port and starboard hull portions 17 and 18 of the inflatable skin 12.

Referring to FIGS. 1, 3, 4A, 4B, 5A and 5B, the port chine stiffener 36 extends lengthwise between the port deck chamber 64 and the port hull chamber 68, and the starboard chine stiffener 38 extends lengthwise between the starboard deck chamber 66 and the starboard hull chamber 70 along a mid portion of the watercraft 10. The port and starboard chine stiffeners 36 and 38 may be wide enough apart for a seat to fit between them, and may be positioned to allow for the attachment of, e.g., seat straps and foot supports. The port and starboard chine stiffeners 36 and 38 are bent near the bow and stern 19 and 21 of the watercraft 10 to lie on top of the port and starboard deck chambers 64 and 66, respectively, to facilitate expanding the sides of the inflatable skin 12, and together with the keel member 16 to form an attractive, functional bow and stern 19 and 21 of the watercraft.

The keel member 16, port and starboard chine stiffeners 36 and 38 are shaped to curve upwardly for receipt in the bow and stern connectors 13 and 15 to lie on the port and starboard deck chambers 64 and 66 of the inflatable skin 12.

Referring to FIGS. 1, 3, 4C, 4D and 5C, in an alternative embodiment the frame 14 may comprise port and starboard gunwale stiffeners 40 and 42 connectable to the keel member 16 to extend lengthwise over port and starboard hull portions 17 and 18 of the inflatable skin 12. In this embodiment, the port and starboard gunwale stiffeners 40 and 42 are configured to extend lengthwise along the port deck chamber 64 and the starboard deck chamber 66, respectively. Near amidships, the port and starboard gunwale stiffeners 40 and 42 are connected to the port and starboard deck skin portions 56 and 58 by webbing loops (not shown). The port and starboard gunwale stiffeners 40 and 42 are connected at the bow and stern 19 and 21 of the watercraft 10 directly, without bends. The port and starboard gunwale stiffeners 40 and 42 may be wide enough apart for a seat to fit between them, and may be positioned to allow for the attachment of, e.g., seat straps and/or foot supports.

Alternatively the chine or gunwale stiffeners 36, 38 or 40, 42 may be positioned at other locations. In either embodiment, the chine stiffeners 36 and 38 or the gunwale stiffeners 40 and 42 are pivotally connected to the keel member 16 near the bow 19 and the stern 21 of the watercraft 10 to provide rigidity to the watercraft to stiffen the inflatable skin 12.

Figure 5A:
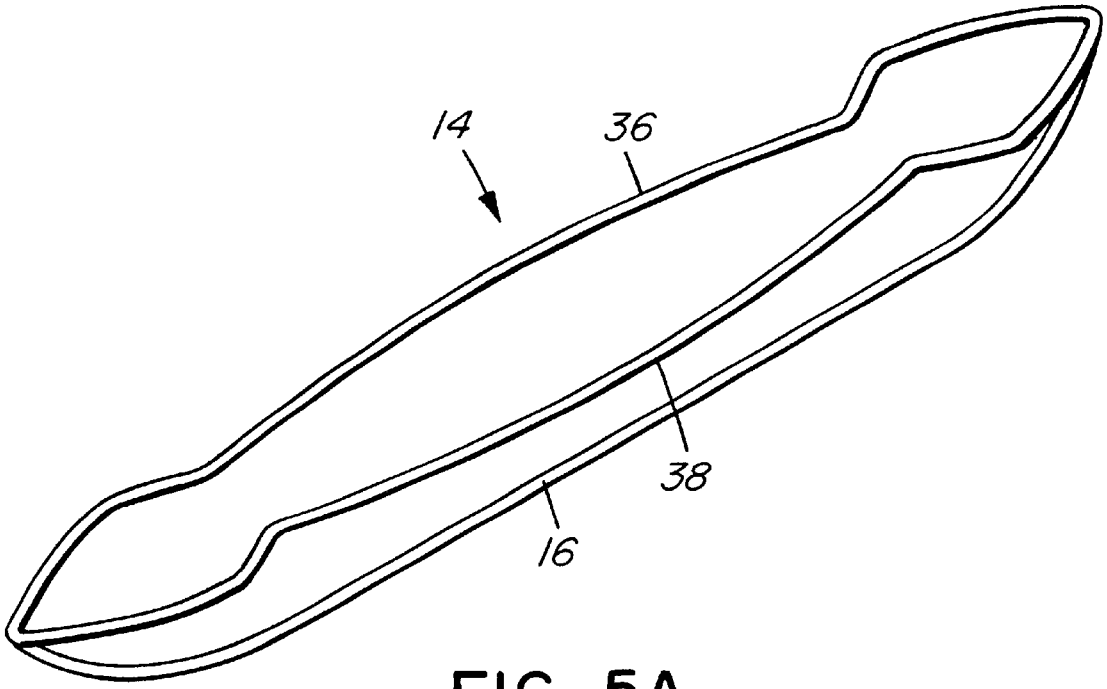
FIG. 5A is an isometric view of a frame of the watercraft shown in FIG. 1.
Figure 5C:
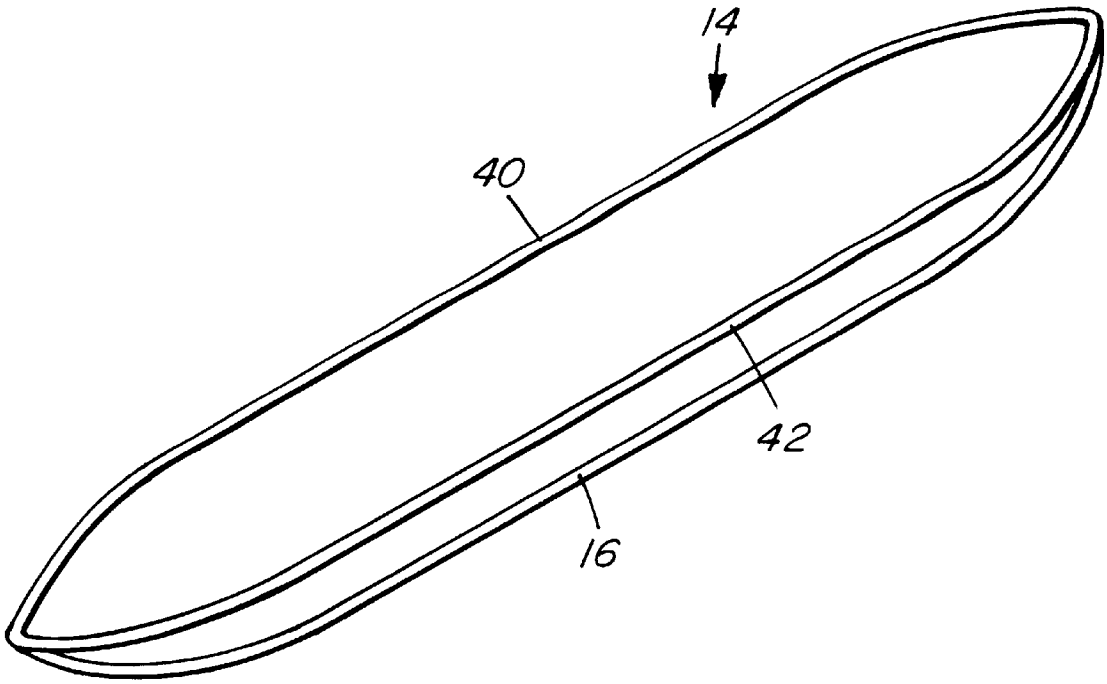
FIG. 5C is an isometric view of a frame of the watercraft according to the alternative embodiment of the invention shown in FIGS. 4C and 4D.
Figure 5B:
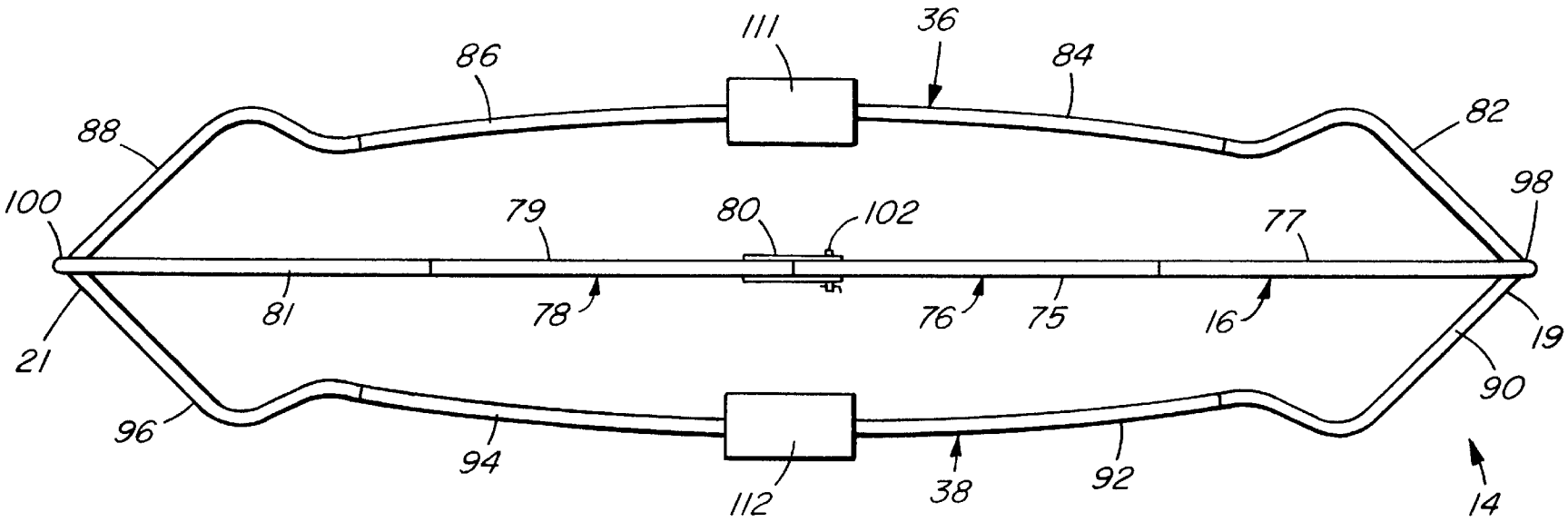
FIG. 5B is a top plan view of the frame shown in FIG. 5A.

Referring to FIG. 5B, the frame 14 is shown separately from the inflatable skin 12 of the watercraft 10. In this embodiment, the keel member 16 and the port and starboard chine stiffeners 36 and 38 are comprised of a plurality of detachable stiffener portions 75, 77, 79, 81, 82, 84, 86, 88, 90, 92, 94, and 96 which can be shockcorded together during assembly to form the frame 14. This is achieved by positioning a shock cord through an insert riveted to an inside surface of a first stiffener portion and knotting the shock cord at one end. The shock cord is stretched and a second end of the shock cord is placed in an internal spacer, riveted to an inside surface of a second stiffener portion, and knotted. In this embodiment both the insert and the spacer are held in place with blind rivets to the first and second stiffener portions, respectively. In this embodiment the plurality of detachable stiffener portions 75, 77, 79, 81, 82, 84, 86, 88, 90, 92, 94, and 96 are made from 6061-T6 anodized aluminum magnesium alloy tubing, which is lightweight and provide high tensile strength and good resistance to corrosion. However, it will be appreciated that other materials may be used for the stiffener portions 75, 77, 79, 81, 82, 84, 86, 88, 90, 92, 94, and 96.

Still referring to FIG. 5B, the keel member 16 comprises first and second keel member portions 76 and 78 which are pivotally connectable to each other at a hinge 102 near the midpoint of the length of the keel member. In this embodiment the first and second keel member portions 76 and 78 comprises two stiffener portions 75 and 77, and 79 and 81, respectively. In this embodiment, stiffener portions 77 and 81 of the first and second keel member portions 76 and 78 are curved upward at the bow and stern 19 and 21 of the watercraft 10 to define a bow and stern end of the frame 14, respectively. Stiffener portions 75 and 79 are relatively straight. The keel member 16 further includes a lock 80 operable to lock the first and second keel member portions 76 and 78 against relative pivotal movement.

Figure 6:
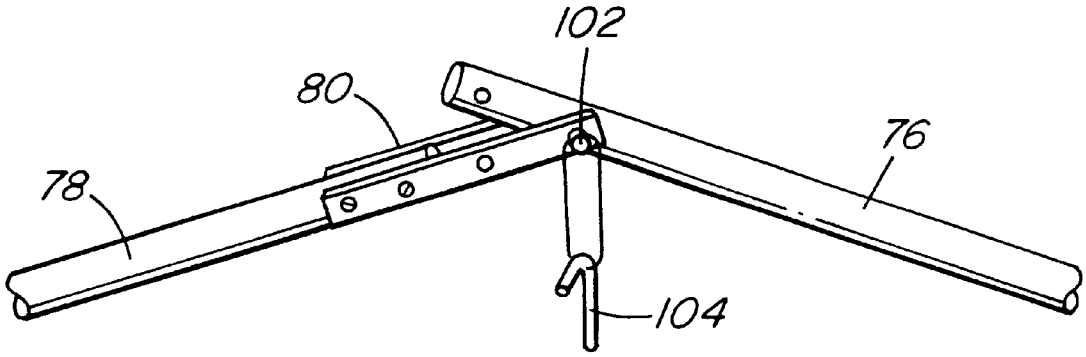
FIG. 6 is a fragmented side view of a keel member of the frame shown in FIGS. 5A, 5B and 5C.

Referring to FIG. 6, the first and second keel member portions 76 and 78 are hinged together at the lock 80 by a pin 102 and are locked by a link pin 104 insertable in alignable openings on the first and second keel member portions, to lock against relative pivotal movement.

Referring back to FIG. 5B, in this embodiment, the port chine stiffener 36 comprises a plurality of segments 82, 84, 86 and 88 which run longitudinally from the bow 19 to the stern 21 of the watercraft 10. Similarly, the starboard chine stiffener 38 comprises four stiffener portions 90, 92, 94 and 96. In the embodiment shown in FIG. 5C, the port and starboard gunwale stiffeners 40 and 42 also comprise a plurality of detachable stiffener portions. The plurality of detachable stiffener portions 82, 84, 86, 88, 90, 92, 94, and 96 in this embodiment include shockcords which act as connectors to connect the stiffener portions together to allow for ease of assembly and disassembly. However, other types of connectors may be envisioned, such as hooks or spring buttons and complementary button receptacles, for example, which join the stiffener portions 82, 84, 86, 88, 90, 92, 94, and 96 together. Near the bow and stern ends 19 and 21 of the watercraft 10, the port and starboard chine stiffener portions 82, 90, 88 and 96 curve upward from the other portions 84, 86, 92 and 94 and are attached at bow and stern joiners 98 and 100, respectively, with through bolts to plastic plates attached to the up-turned stiffener portions 77 and 81 of the keel member 16 at the bow and stern ends of the keel member, respectively. Specifically, detachable stiffener portions 82 and 90 attach to the up-turned stiffener portion 77 of the first keel member portion 76 at the bow joiner 98 and the detachable stiffener portions 88 and 96 join the up-turned stiffener portion 81 of the second keel member portion 78 at the stern joiner 100.

In the alternative embodiment shown in FIGS. 4C, 4D, and 5C, the port and starboard gunwale stiffeners 40 and 42 do not curve upward at the bow and stern ends 19 and 21 of the watercraft 10 but are relatively straight to lie on the port and starboard deck chambers 64 and 66, respectively.

Figure 7:
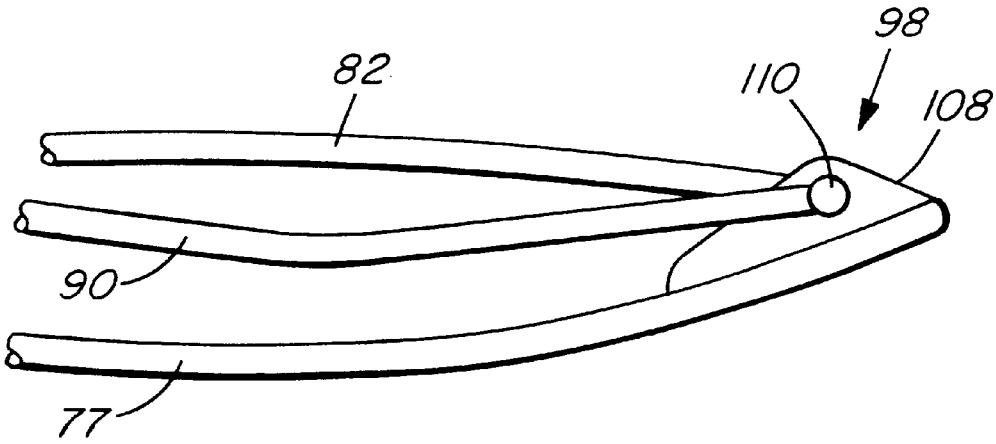
FIG. 7 is a fragmented side view of a bow connector of the frame shown in FIGS. 5A, 5B and 5C.

Referring to FIG. 7, the bow joiner, shown generally at 98, joins the port chine stiffener portion 82, the starboard chine stiffener portion 90 and the up-turned stiffener portion 77 of the first keel member portion 76 together at a plastic plate 108 with a through bolt 110. Similarly, the bow joiner 98 joins port and starboard stiffener portions of the port and starboard gunwale stiffeners 40 and 42, in the embodiment shown in FIG. 5C. Alternatively, any other form of a connector may be used which connects the keel member 16 and the port and starboard chine stiffeners 36 and 38 or port and starboard gunwale stiffeners 40 and 42 together at the bow end 19 of the frame 14 of the watercraft 10. The stern joiner 100 is similar in construction to the bow joiner 98. The bow and the stern joiners 98 and 100 are receivable in the bow and the stern connectors 13 and 15, respectively, on the inflatable skin 12.

Referring back to FIGS. 1 and 3, in this embodiment the bow and stern connectors 13 and 15 are comprised of a generally triangular flap 33 formed from the port and starboard deck skin portions 56 and 58 extending between the port deck chamber 64 and the starboard deck chamber 66 so that the flap is operable to receive the bow and stern joiners 98 and 100 of the frame 14. In other words, the bow and stern connectors 13 and 15 of the inflatable skin 12 act as receptacles for receiving the bow and stern joiners 98 and 100 of the frame 14 for connecting the inflatable skin to the frame at the bow 19 and stern 21 of the watercraft 10.

Referring back to FIG. 5B, in addition, the port and starboard chine stiffeners 36 and 38 include in this embodiment two foot supports 111 and 112 which lie at the joining of the port chine stiffener portions 84 and 86 and starboard chine stiffener portions 92 and 94, respectively. Alternatively, in other embodiments the foot support may be on either one of the portions of the port or starboard chine stiffeners 36 or 38. Similarly foot supports may be positioned on the port and starboard gunwale stiffeners 40 and 42.

Assembly

Referring to FIGS. 1, 4A, 4B, 5A, 5B, and 8, in order to assemble the watercraft 10, the inflatable skin 12 is first unfolded. Deflated sponsons 24, 26, 28 and 30 are then inserted or are pre-inserted into respective chambers 64, 66, 68 and 70. The bow joiner 98 connected to the port and starboard chine stiffener portions 82 and 90, and the up-turned stiffener portion 77 of the first keel member portion 76 is then inserted into the bow connector 13 at the bow 19 of the watercraft 10. The bow joiner 98 is centered so that the first keel member portion 76 is positioned in the keel pocket 44 shown in FIGS. 1, 4A, and 4B between the port and starboard hull portions 17 and 18. The bow joiner 98 is then pushed snug into the bow connector 13 in the bow 19 of the watercraft 10. The stern joiner 100 is similarly positioned in the stern connector 15 of the watercraft 10, and is centered so that the second keel member portion 78 is positioned in the keel pocket 44. The straight stiffener portions 75 and 79 of the first and second keel member portions 76 and 78 are attached to the up-turned stiffener portions 77 and 81, respectively. At this stage, the watercraft has the appearance as shown in broken outline at 140 in FIG. 8.

Figure 8:
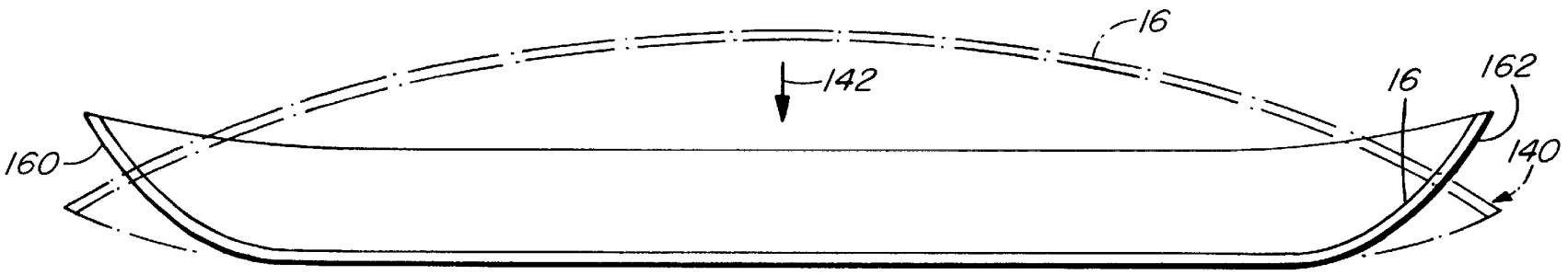
FIG. 8 is a side view of the watercraft shown in FIG. 1 showing two positions of the keel member.

The first keel member portion 76 is then pivoted downwardly relative to the second keel member portion 78 as shown by an arrow 142 in FIG. 8 to extend the extendible keel member 16 of the frame 14 to engage the keel member with the inflatable skin 12 to stretch the inflatable skin to define the rigid keel form 41 therein, as shown in FIG. 3. The first and second keel member portions 76 and 78 are pushed downwardly until the pin 104 of the lock 80 shown in FIG. 6 may be inserted through the openings on the first and second keel member portions to lock the first and second keel member portions against relative pivotal movement. The hook and loop fasteners (not shown) may then be connected to hold the keel member 16 in place.

The port and starboard chine stiffener portions 82, 88, 90 and 96 are rotated upwards to lie above the keel member 16. The port and starboard chine stiffener portions 84, 86 and 92, 94 are then respectively joined to the bow and stern joiners 98 and 100 while being held up in the air in an arc above the keel member 16. Specifically, the port chine stiffener portions 84 and 86 are shockcorded together and attached to port chine stiffener portions 82 and 88 of the bow and stern joiners 98 and 100, respectively. Similarly, the starboard chine stiffener portions 92 and 94 are shockcorded together and attached to starboard chine stiffener portions 90 and 96 of the bow and stern joiners 98 and 100, respectively.

Figure 9:
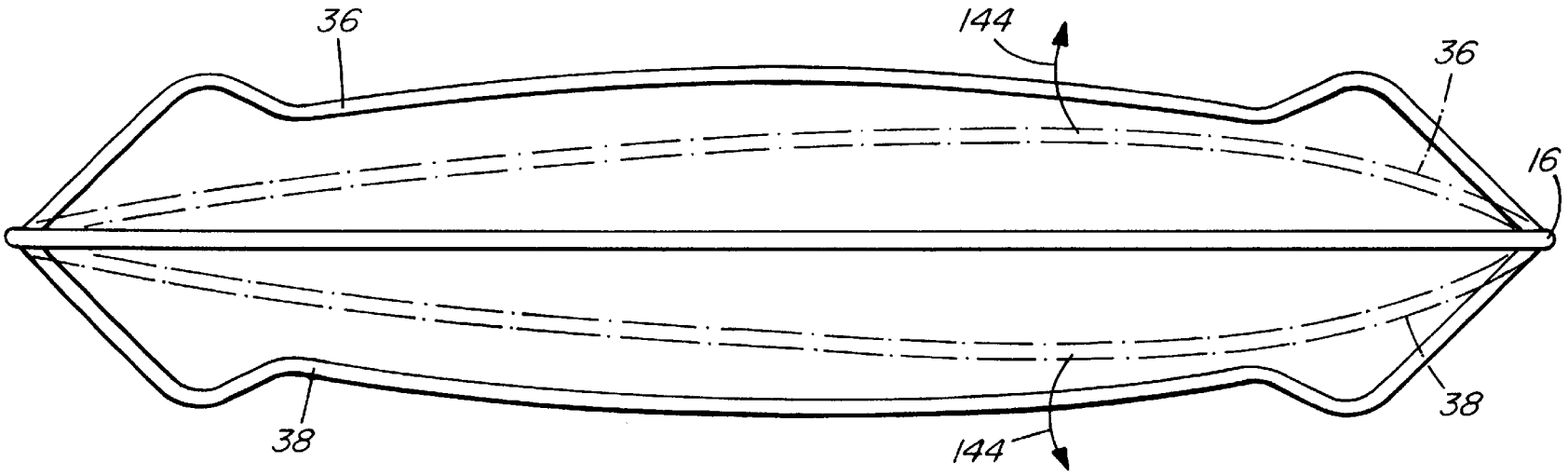
FIG. 9 is a top view of the frame shown in FIGS. 5A and 5B showing two positions of the port and starboard chine stiffeners.

Referring to FIG. 9, a downward and outward force in the direction of the indicated arrow 144 is then applied to the port and starboard chine stiffeners 36 and 38 while rotating the stiffeners toward the keel member 16 and respective port and starboard deck sponsons 24 and 26. This motion lengthens the distance between the bow and stern 19 and 21 of the watercraft 10 and stretches the inflatable skin 12 longitudinally along the keel member 16 from bow to stern. The port and starboard chine stiffeners 36 and 38 are tucked inside the triangular flap 33 of the port and starboard deck skin portions 56 and 58 extending between the port deck chamber 64 and the starboard deck chamber 66 to receive the bow and stern joiners 98 and 100 of the frame 14 in the bow and stern connectors 13 and 15 of the inflatable skin 12 to connect the inflatable skin to the frame at the bow 19 and stern 21 of the watercraft 10. In this embodiment, the port and starboard chine stiffeners 36 and 38 are held in a pocket 33 formed between the port deck chamber 64 and the port hull chamber 68 and between the starboard deck chamber 66 and the starboard hull chamber 70 by means of a hook and loop fastener (not shown). The port and starboard chine stiffeners 36 and 38 are bent up before joining the bow and stern joiners 98 and 100. When the inflatable sponsons 24, 26, 28 and 30 are inflated the port and starboard chine stiffeners 36 and 38 are forced apart. This causes the stiffener portions 82, 88, 90 and 96 to spread apart, which are then retained by the bow and stern connectors 13 and 15, respectively. In other words, the port and starboard chine stiffeners 36 and 38 engage the inflatable skin 12 of the watercraft 10 to stiffen the inflatable skin.

The bends in the first and second keel member portions 76 and 78 produce a slightly upturned bow 19 and stern 21 of the watercraft 10 as shown at 160 and 162 in FIG. 8, and provides the watercraft 10 with greater ability to pivot in water and reduces the risk of water entry into the watercraft. The lift 160 and 162 is confined to a small region near the bow 19 and the stern 21 of the watercraft 10 leaving a relatively long waterline 22 shown in FIG. 2 along the length of the inflatable skin 12.

Referring to FIGS. 3, 4B, 5B and 10, the port and starboard deck and hull sponsons 24, 26, 28, and 30 are then inflated to inflate the inflatable skin 12 and to stretch the inflatable skin outwards, from the keel member 16. The port and starboard foot pedals 111 and 112 are attached to the port and starboard chine stiffeners 36 and 38, respectively.

Referring back to FIGS. 4C, 4D, 5C, and 8, in this embodiment, a similar path of assembly is followed until the watercraft 10 has the appearance as shown in broken outline at 140 in FIG. 8. However, before the keel member 16 is inserted into the inflatable skin 12, a port and a starboard gunwale lever (not shown) are first employed to expand the port and starboard gunwale stiffeners 40 and 42 to stretch the inflatable skin. Specifically, the port lever is attached or may be pre-attached to the port gunwale stiffener 40, and the port lever is levered downward to push apart two port gunwale stiffener portions towards the bow and stern 19 and 21 of the watercraft 10, respectively, to stretch the port deck skin portion 56 of the inflatable skin 12. The lever is pushed down until a spring button on one port gunwale stiffener portion pops into a receptacle on the other port gunwale stiffener portion. Similarly the starboard gunwale stiffener 42 is expanded to stretch the starboard deck skin portion 58 of the inflatable skin 12. The keel member 16 is then expanded and the inflatable sponsons 24, 26, 28, and 30 are inflated in the way previously described.

Figure 10:
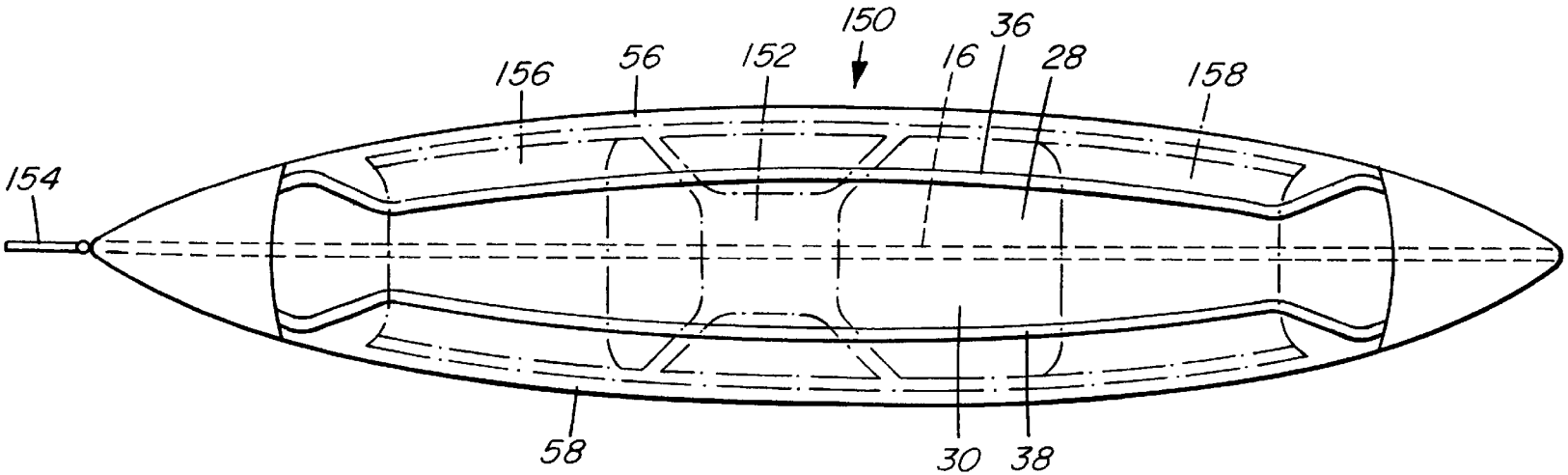
FIG. 10 is a top view of a watercraft according to an alternative embodiment of the invention.

An alternate embodiment of the assembled watercraft is shown generally at 150 in FIG. 10. In this embodiment, a seat 152, rudder 154 and deck riggings 156 and 158 are attached to mounts (not shown) on the port and starboard sewn cloth deck 56 and 58, respectively.

Figure 11:
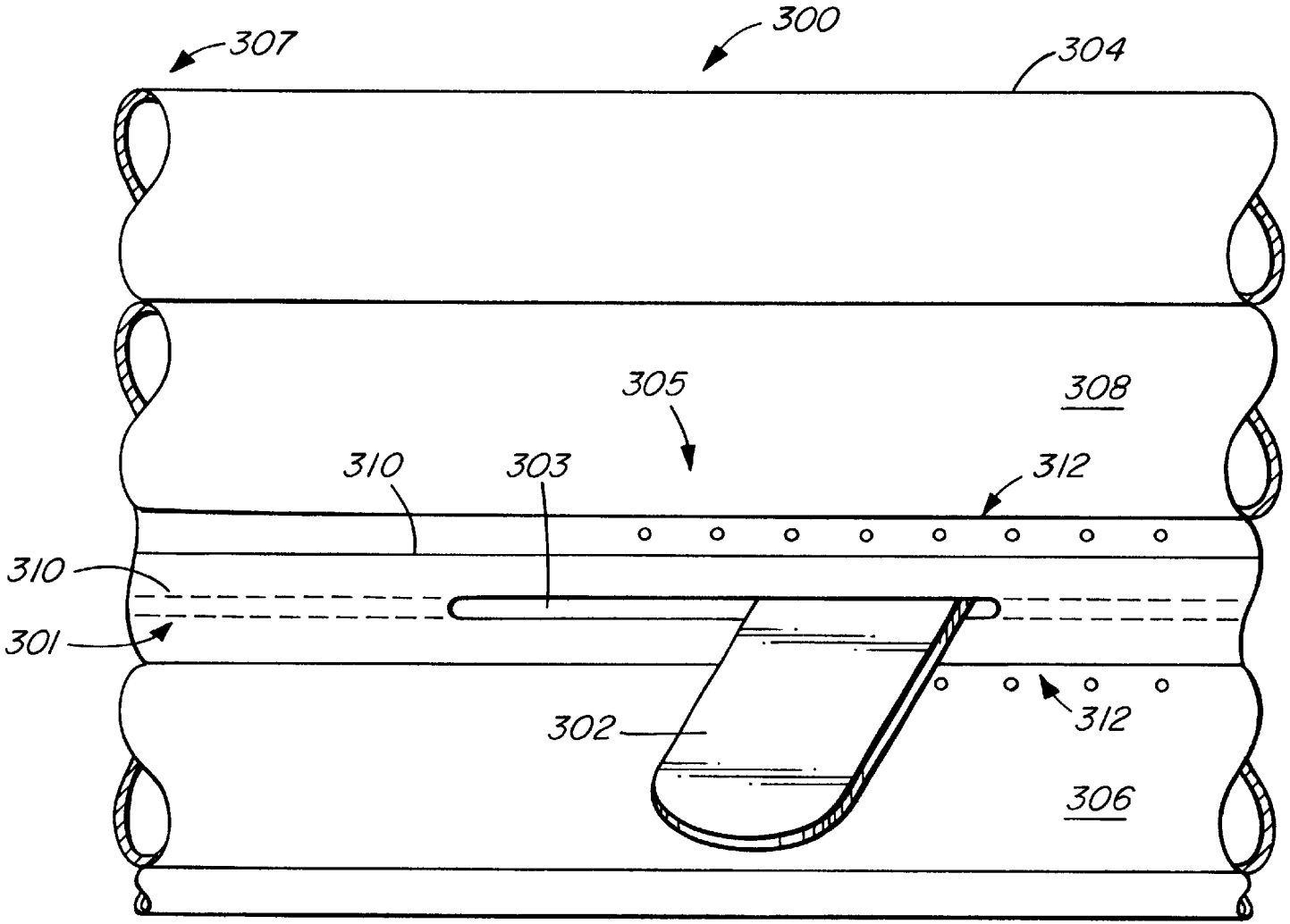
FIG. 11 is a fragmented bottom view of a watercraft according to another alternative embodiment of the invention.
Figure 12:
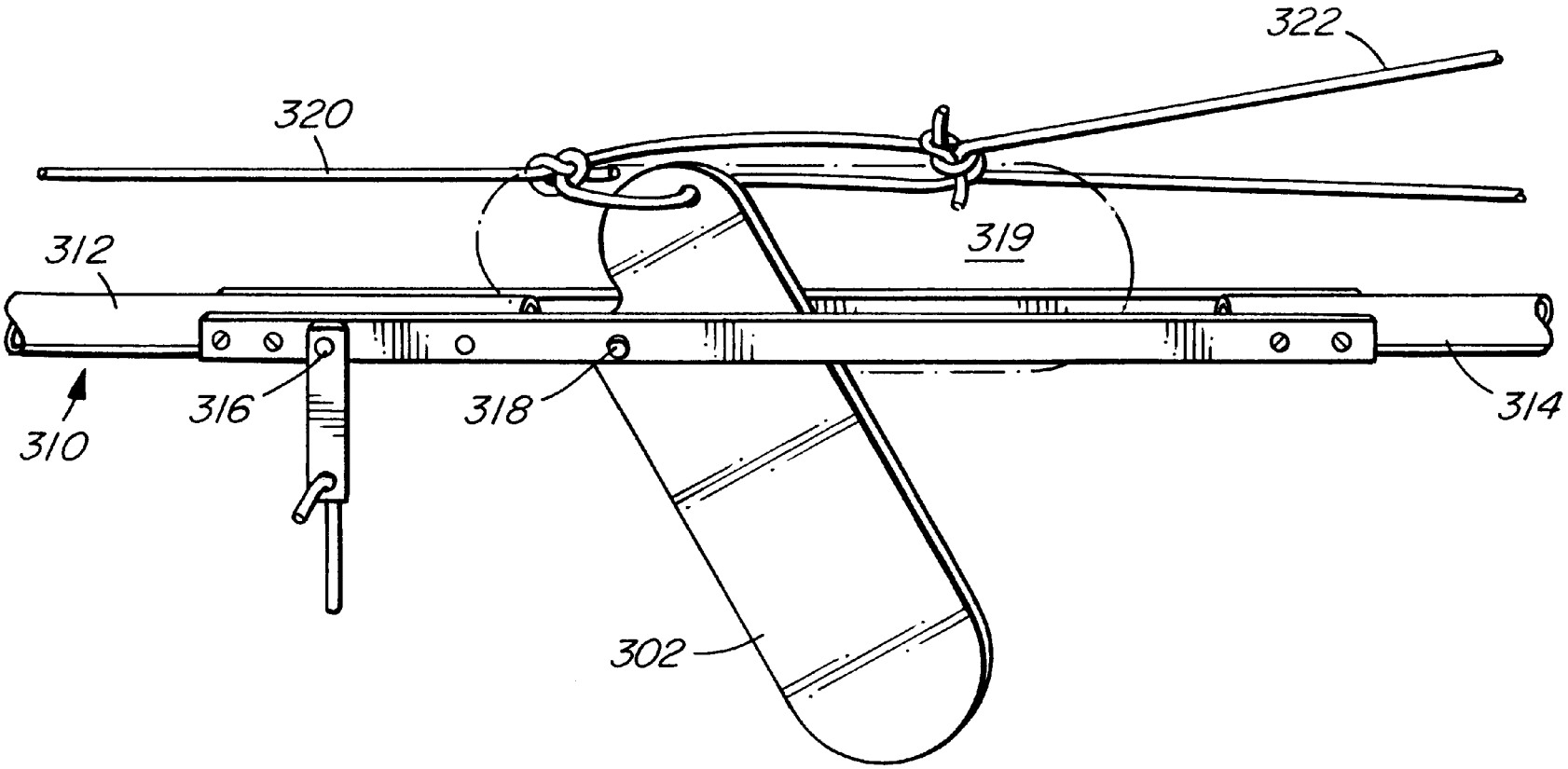
FIG. 12 is a fragmented side view of a keel member of a frame of the watercraft according to the embodiment shown in FIG. 11.

Referring to FIGS. 11 and 12, another alternative embodiment of the watercraft is shown generally at 300. In this embodiment, the keel member 310 of the frame 301 supports a retractable drop skeg 302 that is operable to be positioned to protrude through an opening 303 of the hull skin portion 305 beneath the inflatable skin 304 between the port and starboard hull portions 306 and 308 to aid tracking. Alternatively a simpler skeg may be attached to the watercraft 300 by straps, for example, to position the skeg underneath the watercraft near the stern 307. In this embodiment the drop skeg 302 is made of aluminum, but alternatively may be made of any other fairly rigid material. Referring to FIG. 11, In this embodiment the hull skin portion 305 of the inflatable skin 304 includes an additional strip 310 of hull material reinforced to the hull skin portion to support the drop skeg 302 against the inflatable skin. The hull skin portion 305 has the opening 303 as well as additional openings 312 such that the watercraft 300 in this embodiment is self-bailing.

Referring to FIG. 12, the drop skeg 302 is positioned near the hinge 316 of the keel member 310 connecting the first and second keel member portions 312 and 314. The drop skeg 302 is hinged to the second keel member portion 314 at another hinge 318 so that the drop skeg can be retracted into the watercraft 300 in the position shown in dotted outline at 319 in FIG. 12. In this embodiment the first and second keel member portions 312 and 314 of the keel member 310 are configured such that the hinge 316 and the drop skeg 302 are located closer to the stern end of the frame 301. In this embodiment an elasticized cord 320, such as a shock cord, and non-elasticized cord 322 are tied to an edge of the drop skeg 302 to facilitate deployment of the drop skeg. The shock cord 320 is attached near the stern end of the frame 301 while the cord 322 is run to near amidships of the watercraft 300 such that a paddler may pull and cleat the cord to raise the drop skeg 302 into the retracted position 319 withdrawing the drop skeg into the watercraft, and may release the cord such that the shock cord deploys the drop skeg into the water. Alternatively a single continuous loop of cord may be attached to an end of the drop skeg 302 and run through a pivot (not shown) on the frame 301 such that the paddler may raise or lower the drop skeg by pulling on the cord indifferent directions.

Referring back to FIGS. 1 and 3, by performing the above-mentioned steps of assembly, the extendible rigid keel member 16 is engaged with the inflatable skin 12 to stretch the inflatable skin to define the rigid keel form 41 in the inflatable skin. The rigid keel member 16 stretches the hull skin portion 32 to define the rigid keel form 41, which lies at the center of the inflatable skin 12 between the port and starboard hull portions 17 and 18, and curves upward at the bow 19 and stern 21 of the watercraft 10. The chine stiffeners 36 and 38 or the gunwale stiffeners 40 and 42 of the frame 14 when expanded resist the upward curvature of the bow 19 and stern 21, leading to a longer waterline and a faster watercraft.

The features of the frame 14, deflatable sponsons 24, 26, 28, and 30, and detachable accessories 152, 154, 156, and 158 allows the watercraft 150 to be compacted into a small size for travel on board a vehicle such as a plane, for example. In addition, the pressure in the sponsons 24, 26, 28, and 30 and the seat 152 level may be adjusted to determine how far above the water level 20 a paddler wishes to sit. If the seat 152 and air pressure in the sponsons 24, 26, 28, and 30 are set so that paddler sits near the water level 20, the watercraft may be used as a surf ski. If the inflatable skin 12 has openings allowing water trapped along the inflatable skin 12 to drain into surrounding water, the watercraft 10 may be self-bailing.

While specific embodiments of the invention have been described and illustrated, such embodiments should be considered illustrative of the invention only and not as limiting the invention as construed in accordance with the accompanying claims.

What is claimed is:

1. A watercraft comprising:

an inflatable skin operable to define a hull shape when inflated having a port hull portion and a starboard hull portion connected together to form a keel pocket;

a frame comprising an extendible rigid keel member engageable with said inflatable skin lengthwise in said keel pocket to stretch said inflatable skin to define a rigid keel form in said inflatable skin.

2. The watercraft of claim 1 wherein said inflatable skin further comprises bow and stern connectors for connecting said inflatable skin to said frame at a bow and a stern of said watercraft, respectively.

3. The watercraft of claim 1 wherein said port hull portion and said starboard hull portion are inflatable.

4. The watercraft of claim 3 wherein said port and starboard hull portions comprise port and starboard chambers.

5. The watercraft of claim 4 wherein said port and starboard chambers are operable to receive respective inflatable sponsons.

6. The watercraft of claim 5 further including inflatable sponsons operable to be received in said port and starboard chambers.

7. The watercraft of claim 5 wherein said port and starboard hull portions have closeable openings to provide access to said port and starboard chambers to permit insertion and removal of said respective inflatable sponsons.

8. The watercraft of claim 1 wherein said port and starboard hull portions comprise port and starboard hull and deck chambers, respectively.

9. The watercraft of claim 8 wherein said port and starboard deck chambers are operable to receive port and starboard deck sponsons, and said port and starboard hull chambers are operable to receive port and starboard hull sponsons, respectively.

10. The watercraft of claim 9 wherein said port and starboard deck and hull chambers have closeable openings for receiving said port and starboard deck and hull sponsons, respectively.

11. The watercraft of claim 10 further comprising said port and starboard deck and hull inflatable sponsons.

12. The watercraft of claim 4 wherein said inflatable skin further comprises port and starboard dividers dividing said port and starboard chambers into port and starboard deck and hull chambers.

13. The watercraft of claim 1 wherein said inflatable skin further comprises a hull skin portion and port and starboard deck skin portions.

14. The watercraft of claim 13 wherein said hull and said port and starboard deck skin portions are comprised of an abrasion resistant, waterproof fabric.

15. The watercraft of claim 14 wherein said hull and said port and starboard deck skin portions are comprised of urethane coated nylon fabric or urethane coated polyester fabric.

16. The watercraft of claim 14 wherein said hull and said port and starboard deck skin portions are comprised of polyvinyl chloride coated nylon or polyester fabric.

17. The watercraft of claim 14 wherein said hull and said port and starboard deck skin portions are comprised of neoprene or rubber coated nylon or polyester fabric.

18. The watercraft of claim 4 wherein said port and starboard chambers are airtight and operable to be inflated.

19. The watercraft of claim 14 further comprising a seat connectable to said port and starboard deck skin portions.

20. The watercraft of claim 1 further comprising a skeg.

21. The watercraft of claim 1 wherein said keel member comprises first and second keel member portions pivotally connectable to each other.

22. The watercraft of claim 21 further comprising a lock operable to lock said first and second keel member portions against relative pivotal movement.

23. The watercraft of claim 1 wherein said frame further comprises port and starboard chine stiffeners connectable to said keel member to extend lengthwise along port and starboard sides of said inflatable skin.

24. The watercraft of claim 23 wherein said inflatable skin comprises port and starboard hull and deck chambers, respectively, said port and starboard chine stiffeners being extended lengthwise between said port deck chamber and said port hull chamber, and lengthwise between said starboard deck chamber and said starboard hull chamber, respectively, of said inflatable skin.

25. The watercraft of claim 24 wherein said port and starboard chine stiffeners, and said keel member are pivotally connectable to each other.

26. The watercraft of claim 25 wherein said frame further comprises a bow joiner and a stern joiner to join said keel member, and said port and starboard chine stiffeners together, respectively.

27. The watercraft of claim 26 wherein said inflatable skin further comprises bow and stern connectors, said bow and stern joiners cooperate with said bow and stern connectors on said inflatable skin to connect said inflatable skin to said frame at a bow and a stern of said watercraft, respectively.

28. The watercraft of claim 27 wherein said bow and stern connectors on said inflatable skin comprise a receptacle for receiving said bow and stern joiners, respectively, of said frame.

29. The watercraft of claim 28 wherein receptacle comprises a generally triangular shaped flap extending between said port and starboard deck chambers of said inflatable skin at the bow and stern of the watercraft, respectively, said flap being operable to receive said bow and stern joiners of said frame.

30. The watercraft of claim 29 wherein said keel member, port and starboard chine stiffeners are shaped to curve upwardly for receipt into said receptacle to lie on said port and starboard deck chambers of said inflatable skin.

31. The watercraft of claim 23 wherein said port and starboard chine stiffeners are collapsible.

32. The watercraft of claim 31 wherein said keel member, and said port and starboard chine stiffeners comprise a plurality of connectable stiffener portions.

33. The watercraft of claim 32 wherein at least one of said port and starboard chine stiffeners further comprises a foot support.

34. The watercraft of claim 1 wherein said frame further comprises port and starboard gunwale stiffeners connectable to said keel member to extend lengthwise over port and starboard sides of said inflatable skin.

35. The watercraft of claim 34 wherein said inflatable skin comprises port and starboard deck chambers, said port and starboard gunwale stiffeners being extended lengthwise over said port deck chamber, and lengthwise over said starboard deck chamber, respectively, of said inflatable skin.

36. The watercraft of claim 34 wherein said port and starboard gunwale stiffeners, and said keel member are pivotally connectable to each other.

37. The watercraft of claim 35 wherein said port and starboard gunwale stiffeners are collapsible.

38. The watercraft of claim 37 wherein said keel member, and said port and starboard gunwale stiffeners comprise a plurality of connectable stiffener portions.

39. A method of assembling a watercraft, the method comprising:

engaging an elongated keel member of a frame with an inflatable skin operable to define a hull shape when inflated by pivoting a first portion of said keel member relative to a second portion of said keel member and locking said keel member portions against relative pivotal movement when said keel member is engaged with said inflatable skin to stretch said inflatable skin to define a rigid keel form in said inflatable skin; and engaging a chine stiffener with said inflatable skin of said watercraft to stiffen said inflatable skin by rotating said chine stiffener downwardly towards said keel member to stretch said inflatable skin longitudinally along said keel member.

40. The method of claim 39 further comprising inflating said inflatable skin.

41. An inflatable skin for a watercraft, said inflatable skin comprising:

a port hull portion and a starboard hull portion, said port and starboard hull portions being connected together to form a keel pocket operable to receive an extendible rigid member of a frame lengthwise between the hull portions within the keel pocket;

bow and stern connectors operable to connect said inflatable skin to the frame near a bow and a stern of said watercraft, respectively;

wherein said inflatable skin is operable to define a hull shape when inflated, and is engageable with the frame to stretch said inflatable skin to define a rigid keel form in said inflatable skin.

42. The inflatable skin of claim 41 wherein said port hull portion and said starboard hull portion are inflatable.

43. The inflatable skin of claim 42 wherein said port and starboard hull portions comprise port and starboard chambers.

44. The inflatable skin of claim 43 wherein said port and starboard chambers are operable to receive respective inflatable sponsons.

45. The inflatable skin of claim 44 further including inflatable sponsons operable to be received in said port and starboard chambers.

46. The inflatable skin of claim 44 wherein said port and starboard hull portions have closeable openings to provide access to said port and starboard chambers to permit insertion and removal of said respective inflatable sponsons.

47. The inflatable skin of claim 41 wherein said port and starboard hull portions comprise port and starboard hull and deck chambers, respectively.

48. The inflatable skin of claim 47 wherein said port and starboard deck chambers are operable to receive port and starboard deck sponsons, and said port and starboard hull chambers are operable to receive port and starboard hull sponsons, respectively.

49. The inflatable skin of claim 48 wherein said port and starboard deck and hull chambers have closeable openings for receiving said port and starboard deck and hull sponsons, respectively.

50. The inflatable skin of claim 49 further comprising said port and starboard deck and hull inflatable sponsons.

51. The inflatable skin of claim 43 wherein said inflatable skin further comprises port and starboard dividers dividing said port and starboard chambers into port and starboard deck and hull chambers.

52. The inflatable skin of claim 41 wherein said inflatable skin further comprises a hull skin portion and port and starboard deck skin portions.

53. The inflatable skin of claim 52 wherein said hull and said port and starboard deck skin portions are comprised of an abrasion resistant, waterproof fabric.

54. The inflatable skin of claim 53 wherein said hull and said port and starboard deck skin portions are comprised of urethane coated nylon fabric or urethane coated polyester fabric.

55. The inflatable skin of claim 53 wherein said hull and said port and starboard skin portions are comprised of polyvinyl chloride coated nylon or polyester fabric.

56. The inflatable skin of claim 53 wherein said hull and said port and starboard deck skin portions are comprised of neoprene or rubber coated nylon or polyester fabric.

57. The inflatable skin of claim 47 wherein said port and starboard chambers are airtight and operable to be inflated.

58. The inflatable skin of claim 53 further comprising a seat connectable to said port and starboard deck skin portions.

59. The inflatable skin of claim 52 wherein said hull skin portion is operable to support a skeg.

60. A frame for a watercraft the frame comprising:

an extendible rigid keel member having first and second keel member portions pivotally connectable to each other and a lock operable to lock said first and second keel member portions against relative pivotal movement, said keel member being engageable with an inflatable skin of the watercraft to stretch the inflatable skin to define a rigid keel form in the inflatable skin;

port and starboard chine stiffeners connectable to said keel member to extend lengthwise along port and starboard sides of the inflatable skin between a port deck chamber and a port hull chamber, and lengthwise between a starboard deck chamber and a starboard hull chamber, respectively, of the inflatable skin wherein said port and starboard chine stiffeners are operable to be rotated down hardly towards said keel member to stretch the inflatable skin longitudinally along said keel member.

61. The frame of claim 60 wherein said port and starboard chine stiffeners, and said keel member are pivotally connectable to each other.

62. The frame of claim 61 wherein said frame further comprises a bow joiner and a stern joiner to join said keel member, and said port and starboard chine stiffeners together, respectively.

63. The frame of claim 62 wherein said bow and stern joiners cooperate with bow and stern connectors on the inflatable skin to connect the inflatable skin to said frame at a bow and a stern of the watercraft, respectively.

64. The frame of claim 63 wherein said keel member, port and starboard chine stiffeners are shaped to curve upwardly for receipt into a receptacle on the inflatable skin to lie on port and starboard deck chambers of the inflatable skin, respectively.

65. The frame of claim 60 wherein said port and starboard chine stiffeners are collapsible.

66. The frame of claim 65 wherein said keel member, and said port and starboard chine stiffeners comprise a plurality of connectable stiffener portions.

67. The frame of claim 66 wherein at least one of said keel member and said port and starboard chine stiffeners further comprises a foot support.

68. The frame of claim 60 wherein said frame further comprises port and starboard gunwale stiffeners connectable to said keel member to extend lengthwise over port and starboard sides of the inflatable skin.

69. The frame of claim 68 wherein said port and starboard gunwale stiffeners extend lengthwise over a port deck chamber, and lengthwise over a starboard deck chamber, respectively, of the inflatable skin.

70. The frame of claim 69 wherein said port and starboard gunwale stiffeners, and said keel member are pivotally connectable to each other.

71. The frame of claim 70 wherein said port and starboard gunwale stiffeners are collapsible.

72. The frame of claim 71 wherein said keel member, and said port and starboard gunwale stiffeners comprise a plurality of connectable stiffener portions.

73. The frame of claim 60 wherein said keel member is operable to support a skeg.

74. The frame of claim 73 further comprising said skeg.

75. A watercraft comprising:

an inflatable skin operable to define a hull shape when inflated having a port hull portion and a starboard hull portion;

a frame comprising an extendible rigid keel member engageable with said inflatable skin lengthwise between said port hull portion and said starboard hull portion to stretch said inflatable skin to define a rigid keel form in said inflatable skin; and said port hull portion and said starboard hull portion being inflatable and having port and starboard chambers operable to receive respective inflatable sponsons;

said port and starboard hull portions have closeable openings to provide access to said port and starboard chambers to permit insertion and removal of said respective inflatable sponsons.

76. A watercraft comprising:

an inflatable skin operable to define a hull shape when inflated having a port hull portion and a starboard hull portion;

a frame comprising an extendible rigid keel member engageable with said inflatable skin lengthwise between said port hull portion and said starboard hull portion to stretch said table skin to define a rigid keel form in said inflatable skin; and said port hull portion and said starboard hull portion having port and starboard hull and deck chambers, respectively, operable to receive port and starboard deck sponsons and port and starboard hull sponsons, respectively;

wherein said port and starboard deck and hull chambers have closeable openings for receiving said port and starboard deck and hull sponsons, respectively.

77. A watercraft comprising:

an inflatable skin operable to define a hull shape when inflated having a port hull portion and a starboard hull portion;

a frame comprising an extendible rigid keel member engageable with said inflatable skin lengthwise between said port hull portion and said starboard hull portion to stretch said inflatable skin to define a rigid keel form in said inflatable skin; and said port hull portion and said starboard hull portion being inflatable and having dividers dividing said port and starboard chambers into port and starboard deck and hull chambers.

78. A watercraft comprising:

an inflatable skin operable to define a hull shape when inflated;

a frame comprising an extendible rigid keel member engageable with said inflatable skin to stretch said inflatable skin to define a rigid keel form in said inflatable skin, and port and starboard chine stiffeners connectable to said keel member to extend lengthwise along port and starboard sides of said inflatable skin;

said skin comprising port and starboard hull and deck chambers, respectively, with said port and starboard chine stiffeners extending lengthwise between said port deck chamber and said port hull chamber, and lengthwise between said starboard deck chamber and said starboard hull chamber, respectively, wherein said port and starboard chine stiffeners, and said keel member are pivotally connectable to each other; and said frame includes a bow joiner and a stern joiner to join said keel member and said port and starboard chine stiffeners together, respectively.

79. An inflatable skin for a watercraft, said inflatable skin comprising:

a port hull portion and a starboard hull portion being operable to receive an extendible rigid member of a frame lengthwise therebetween;

said port hull portion and said starboard hull portion having port and starboard hull and deck chambers, respectively, operable to receive port and starboard deck sponsons and port and starboard hull sponsons, respectively;

said port and starboard deck and hull chambers having closeable openings for receiving said port and starboard deck and hull sponsons, respectively;

bow and stern connectors operable to connect said inflatable skin to the frame near a bow and a stern of said watercraft, respectively;

wherein said inflatable skin is operable to define a hull shape when inflated, and is engageable with the frame to stretch said inflatable skin to define a rigid keel form in said inflatable skin.

80. A frame for a watercraft, the frame comprising:

an extendible rigid keel member engageable with an inflatable skin of the watercraft to stretch the inflatable skin to define a rigid keel form in the inflatable skin;

port and starboard chine stiffeners connectable to said keel member to extend lengthwise along port and starboard sides of the inflatable skin between a port deck chamber and a port hull chamber, and lengthwise between a starboard deck chamber and a starboard hull chamber, respectively, of the inflatale skin;

said port and starboard chine stiffeners and said keel member being pivotally connectable to each other;

a bow joiner and a stern joiner to join said keel member, and said port and starboard chine stiffeners together, respectively; said bow and stern joiners cooperating with bow and stern connectors on the inflatable skin to connect the inflatable skin to said frame at a bow and a stern of the watercraft, respectively;

said keel member, port and starboard chine stiffeners being shaped to curve upwardly for receipt into a receptacle on the inflatable skin to lie on port and starboard deck chambers of the inflatable skin, respectively.

* * * * *